US007795790B2

(12) United States Patent
Lineton

(10) Patent No.: US 7,795,790 B2
(45) Date of Patent: Sep. 14, 2010

(54) SPARK PLUG ELECTRODE AND PROCESS FOR MAKING

(75) Inventor: Warran B. Lineton, Ann Arbor, MI (US)

(73) Assignee: Federal-Mogul Worldwide, Inc., Southfield, MI (US)

( * ) Notice: Subject to any disclaimer, the term of this patent is extended or adjusted under 35 U.S.C. 154(b) by 556 days.

(21) Appl. No.: 11/670,790

(22) Filed: Feb. 2, 2007

(65) Prior Publication Data

US 2008/0185948 A1 Aug. 7, 2008

(51) Int. Cl.
*H01T 1/24* (2006.01)

(52) U.S. Cl. ..... 313/141; 445/7; 445/46; 123/169 EL

(58) Field of Classification Search ..... None
See application file for complete search history.

(56) References Cited

U.S. PATENT DOCUMENTS

| | | | | |
|---|---|---|---|---|
| 4,540,910 | A * | 9/1985 | Kondo et al. | 313/11.5 |
| 5,461,210 | A | 10/1995 | Matsutani et al. | |
| 5,461,276 | A | 10/1995 | Matsutani et al. | |
| 5,736,809 | A | 4/1998 | Matsutani et al. | |
| 5,973,443 | A | 10/1999 | Chang et al. | |
| 5,977,695 | A | 11/1999 | Osamura et al. | |
| 6,071,163 | A | 6/2000 | Chang et al. | |
| 6,093,071 | A | 7/2000 | Osamura et al. | |
| 6,094,000 | A | 7/2000 | Osamura et al. | |
| 6,262,522 | B1 | 7/2001 | Osamura et al. | |
| 6,304,022 | B1 | 10/2001 | Matsutani | |
| 6,412,465 | B1 | 7/2002 | Lykowski et al. | |
| 6,533,629 | B1 | 3/2003 | Boehler et al. | |
| 6,676,468 | B2 | 1/2004 | Ishiguro et al. | |
| RE38,536 | E | 6/2004 | Reznik | |
| 6,844,662 | B2 | 1/2005 | Morita et al. | |
| 6,885,135 | B2 | 4/2005 | Kanao et al. | |
| 6,885,136 | B2 | 4/2005 | Orjela et al. | |
| 6,971,937 | B2 | 12/2005 | Menken et al. | |
| 7,145,287 | B2 | 12/2006 | Kato | |
| 2008/0278053 | A1 * | 11/2008 | Kumagai et al. | 313/141 |

* cited by examiner

*Primary Examiner*—Ashok Patel
(74) *Attorney, Agent, or Firm*—Robert L. Stearns; Dickinson Wright, PLLC

(57) ABSTRACT

A spark plug and method for making. The spark plug comprises a center electrode, an insulator surrounding the center electrode, and a metallic shell surrounding the insulator. The spark plug also includes a ground electrode engaged with the metallic shell. The ground electrode has a first surface facing the center electrode for defining a spark gap and a second surface opposite the first surface. A cross-section of the ground electrode between the first and second surfaces includes a first zone of a non-noble metallic base material extending a distance from the second surface toward the first surface and a second zone of a blend of the non-noble base material and a noble metallic material extending from the first zone to the first surface. A method of making the spark plug includes the step of disposing a quantity of noble metallic material on an electrode blank formed of a non-noble metallic base material. The method also includes the step of at least partially melting the quantity of noble metal with a beam emitted by a laser. The method also includes the step of sequentially moving the laser along the electrode blank in first and second opposite directions to enhance the distribution of the molten quantity of noble metal over the electrode blank.

13 Claims, 8 Drawing Sheets
(5 of 8 Drawing Sheet(s) Filed in Color)

SPARK PLUG ELECTRODE AND PROCESS FOR MAKING

BACKGROUND OF THE INVENTION

1. Field of the Invention

The invention relates to spark plugs and more particularly to the electrodes of spark plugs and methods of making a spark plug electrode with a noble metal.

2. Description of Related Art

Internal combustion engines utilize spark plugs to ignite a compressed mixture of air gasoline. Each spark plug includes a portion disposed in a cylinder of the engine; the portion including two electrodes spaced from one another. A voltage is applied across the two electrodes, resulting in a spark that initiates combustion. In operation, charges of up to about 40,000 volts may be applied through the spark plug center electrode, causing a spark to jump the gap between the center electrode and the opposing ground electrode. Due to the very nature of an internal combustion engine, spark plugs are exposed to extreme conditions in operation, such as high temperatures and pressures, as well as corrosive combustion gases.

SUMMARY OF THE INVENTION

A spark plug and method for making. The spark plug comprises a center electrode, an insulator surrounding the center electrode, and a metallic shell surrounding the insulator. The spark plug also includes a ground electrode engaged with the metallic shell. The ground electrode has a first surface facing the center electrode for defining a spark gap and a second surface opposite the first surface. A cross-section of the ground electrode between the first and second surfaces includes a first zone of a non-noble metallic base material extending a distance from the second surface toward the first surface and a second zone of a blend of the non-noble base material and a noble metallic material extending from the first zone to the first surface. A method of making the spark plug includes the step of disposing a quantity of noble metallic material on an electrode blank formed of a non-noble metallic base material. The method also includes the step of at least partially melting the quantity of noble metal with a beam emitted by a laser. The method also includes the step of sequentially moving the laser along the electrode blank in first and second opposite directions to enhance the distribution of the molten quantity of noble metal over the electrode blank.

BRIEF DESCRIPTION OF THE DRAWINGS

The patent or application file contains at least one drawing executed in color. Copies of this patent or patent application publication with color drawings will be provided by the Office upon request and payment of the necessary fee.

Advantages of the present invention will become more readily appreciated when considered in connection with the following detailed description and appended drawings, wherein.

DETAILED DESCRIPTION OF THE EXEMPLARY EMBODIMENT

Figure 1:
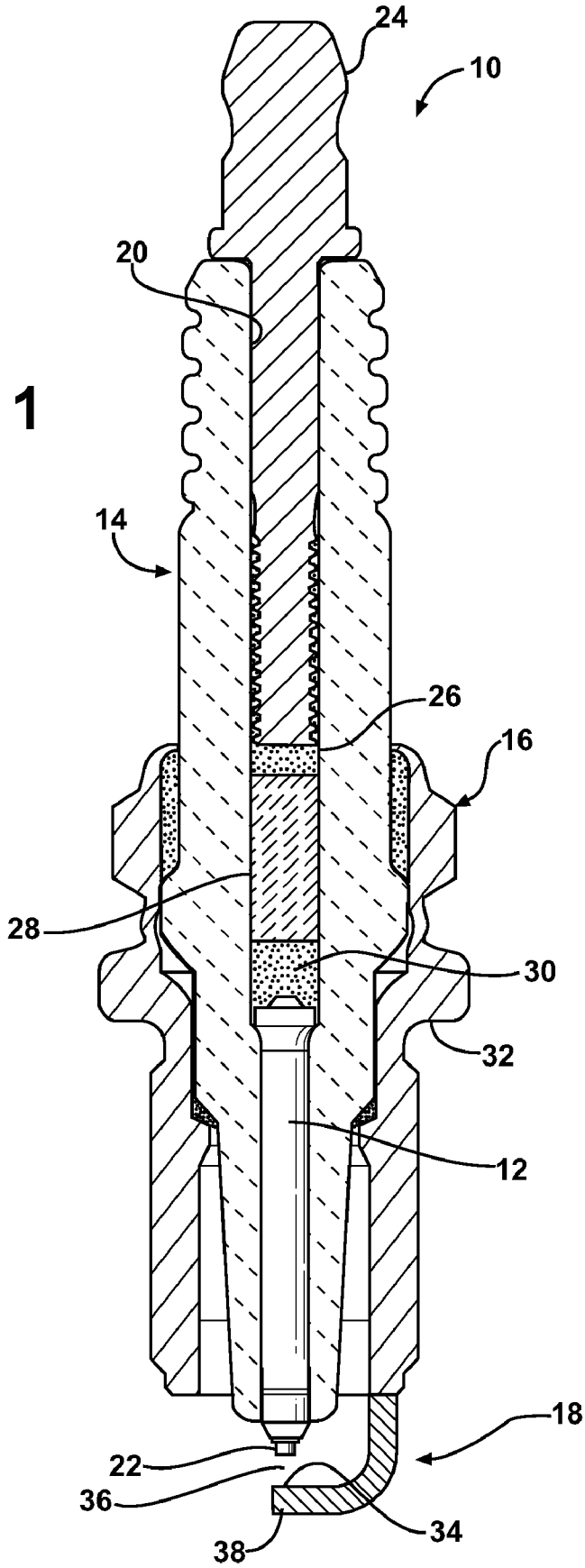
FIG. 1 is a cross-sectional view of a spark plug according to the exemplary embodiment of the invention.

Referring to FIG. 1, a spark plug 10 according to the exemplary embodiment of the invention includes a center electrode 12, an insulator 14 surrounding the center electrode 12, and a metallic shell 16 surrounding the insulator 14. The center electrode 12 is partially disposed in a central passage 20 of the insulator 14 and extends longitudinally to an exposed sparking tip 22. The center electrode 12 receives current from the vehicle through a terminal stud 24, a first conductive glass seal 26, a resistor layer 28, and a second conductive glass seal 30. The center electrode 12 can be made according to any of the known techniques.

The insulator 14 surrounding the center electrode 12. The insulator can be made from aluminum oxide or other suitable material having acceptable dielectric strength, mechanical strength, thermal conductivity, and resistance to heat shock. The insulator 14 may be molded dry under extreme pressure and then kiln-fired to vitrification at high temperature. The insulator 14 has an outer surface which may include a partially exposed upper mast portion to which a rubber spark plug boot (not shown) surrounds and grips to maintain a connection with the ignition system. The exposed mast portion may include a series of ribs to provide added protection against spark or secondary voltage flash-over and to improve grip with the spark plug boot. The insulator 14 is of generally tubular construction.

The metallic shell 16 is generally tubular and includes a seat 32, optionally cooperating with a gasket (not shown), to provide a suitable interface against which the spark plug 10 seats in the cylinder head. The shell 16 also provides the ground for the electric circuit defined when a spark is generated by the spark plug 10. It is noted that the spark plug 10 is an exemplary construction; any spark plug configuration or construction can be practiced with the invention.

Figure 2:
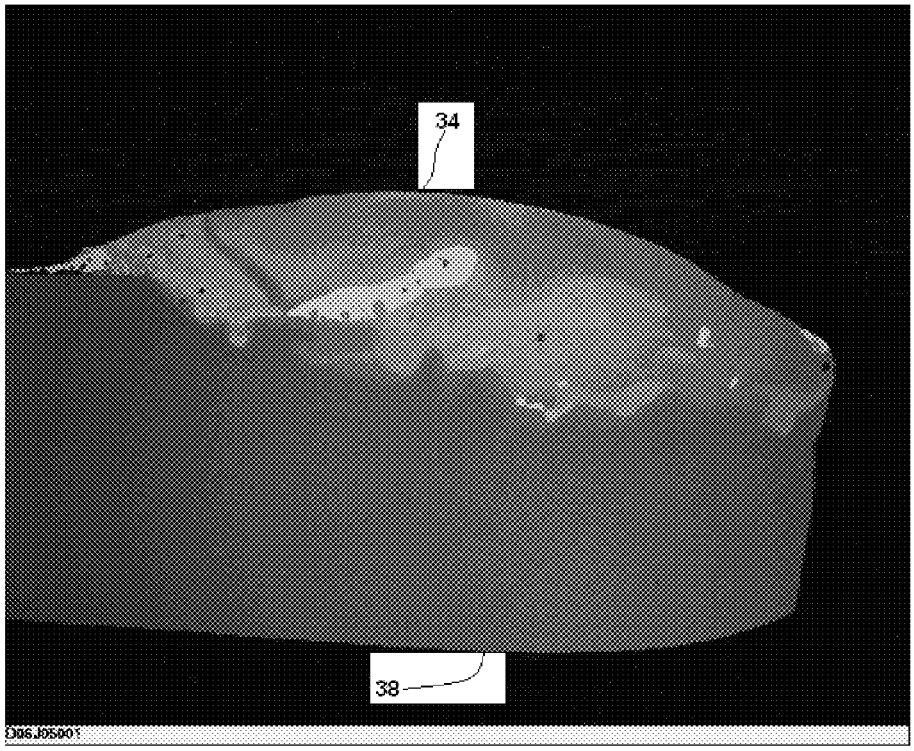
FIG. 2 is a black and white scanning electron microscope (SEM) image showing a cross-section of the ground electrode of the exemplary spark plug.

The spark plug 10 also includes a ground electrode 18 engaged with the metallic shell 16. The ground electrode 18 may be of rectangular cross-section and formed from a non-noble metallic base material, such as a nickel-based alloy including chromium and iron. The ground electrode 18 has a first surface 34 facing the center electrode 12 for defining a spark gap 36 and a second surface 38 opposite the first surface 34. Various cross-sections of the ground electrode 18 between the first and second surfaces 34, 38 are shown in FIGS. 2-6. The various cross-sections are energy dispersive x-ray (EDX) maps that reveal the distribution of elements present in the ground electrode 18. FIG. 2 is a black and white scanning electron microscope (SEM) image. With respect to the orientation of the SEM image on the page, the bottom edge of the relatively darker gray is the second surface 38 and the relatively more rounded surface towards the top of the SEM image is the first surface 34. The relatively darker gray portion of the ground electrode 18 is a first zone of a non-noble metallic base material extending a distance from the second surface 38 toward the first surface 34. In the exemplary embodiment of the invention, the non-noble metallic base material is nickel-based alloy including chromium and iron. The ground electrode 18 also includes a second zone of a blend of the non-noble base material and a noble metallic material extending from the first zone to the first surface 34. In FIG. 2, the second zone is a relatively lighter gray with some concentrated portions appearing white. The relatively white portions are the noble metallic material, iridium in the exemplary embodiment of the invention.

Figure 3:
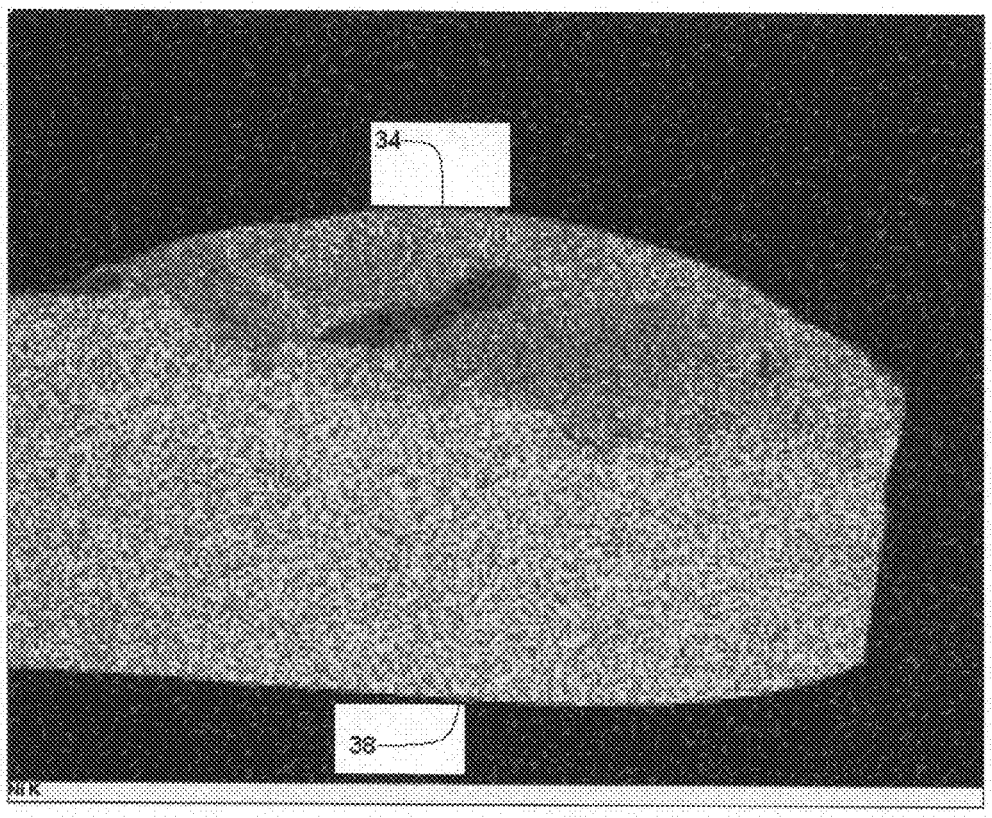
FIG. 3 is an energy dispersive x-ray map showing the distribution of nickel throughout the cross-section of the ground electrode of the exemplary spark plug.
Figure 4:
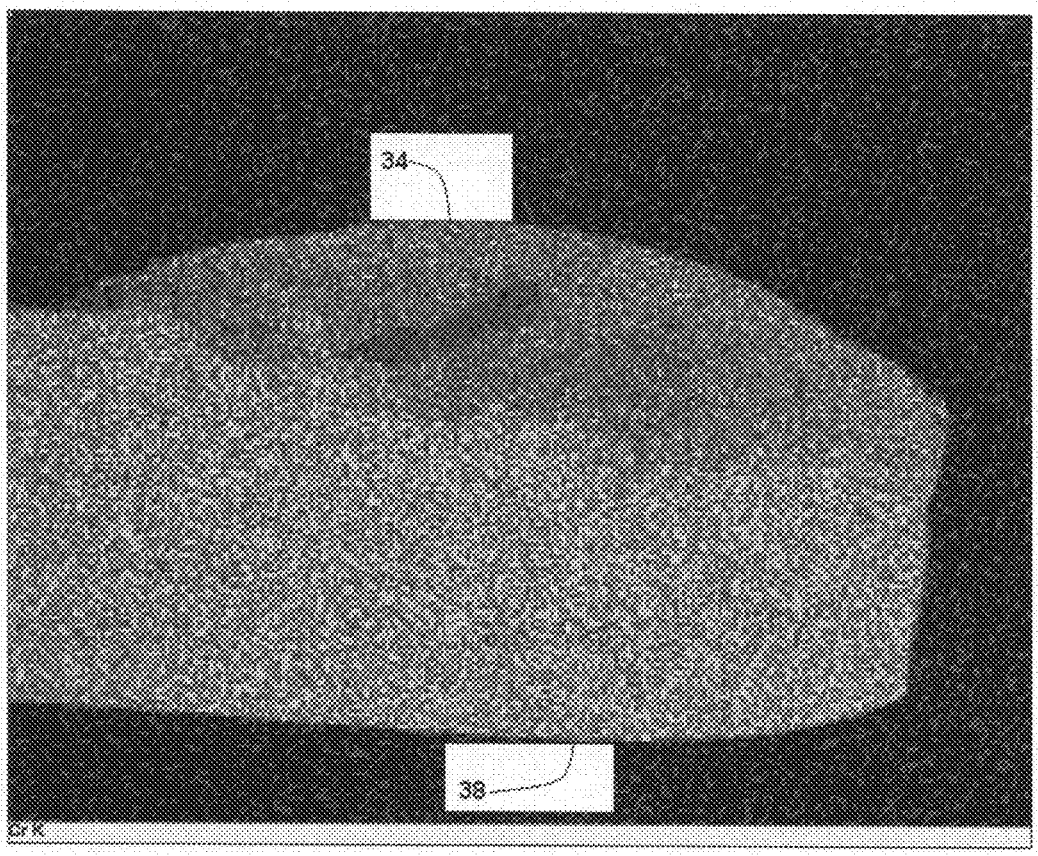
FIG. 4 is an energy dispersive x-ray map showing the distribution of chromium throughout the cross-section of the ground electrode of the exemplary spark plug.
Figure 5:
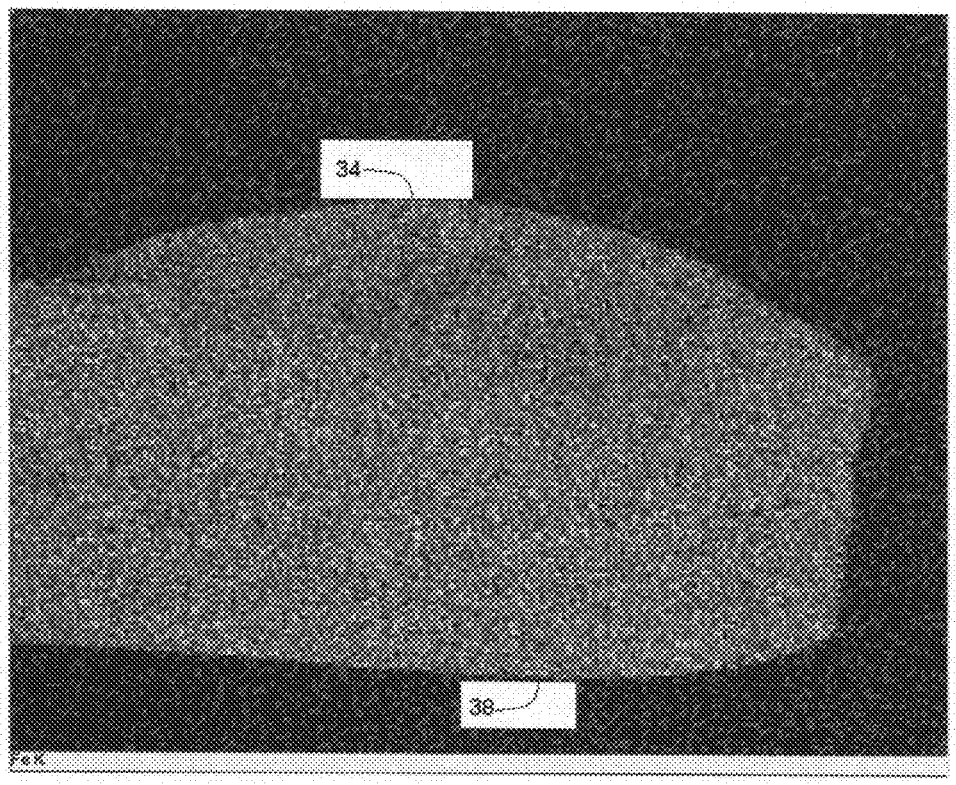
FIG. 5 is an energy dispersive x-ray map showing the distribution of iron throughout the cross-section of the ground electrode of the exemplary spark plug.
Figure 6:
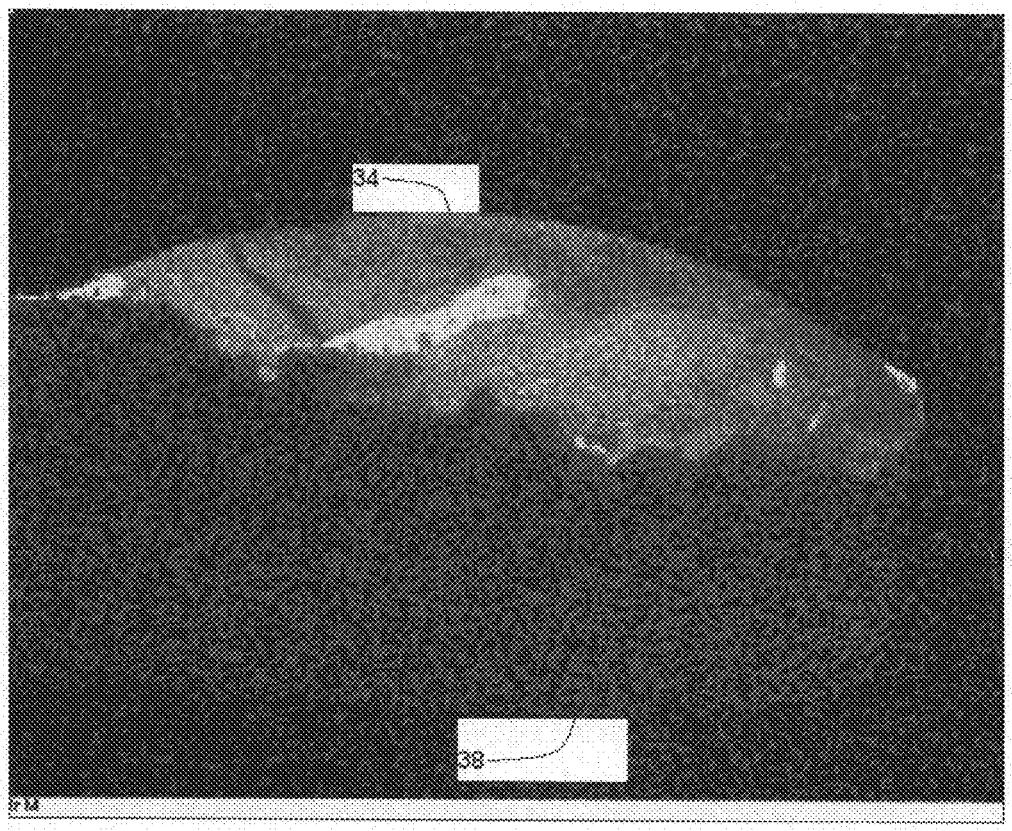
FIG. 6 is an energy dispersive x-ray map showing the distribution of iridium throughout the cross-section of the ground electrode of the exemplary spark plug.
Figure 7:
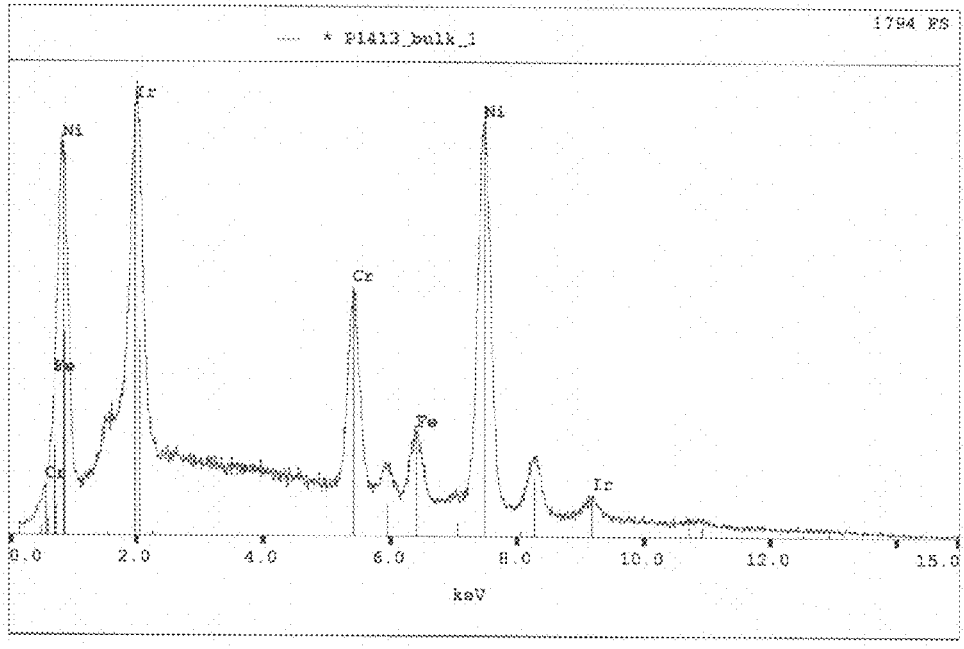
FIG. 7 is an energy dispersive spectrum from elements on a sparking surface of the ground electrode of the exemplary spark plug.

FIG. 2 shows that the non-noble metallic base material is blended with the noble metallic material in the second zone. The first surface 34 is thus a mixture of both the non-noble metallic base material and the noble metallic material, while the first zone is devoid of the noble metallic material. FIG. 3 is a color EDX map of the same cross-section shown in FIG. 2 and emphasizes nickel. In other words, the relatively brighter spots represent higher concentrations of nickel. FIG. 3 shows nickel distributed throughout both the first and second zones. FIG. 4 is a color EDX map of the same cross-section shown in FIG. 2 and emphasizes chromium. FIG. 4 shows chromium distributed throughout both the first and second zones. FIG. 5 is a color EDX map of the same cross-section shown in FIG. 2 and emphasizes iron. FIG. 5 shows iron distributed throughout both the first and second zones. FIG. 6 is a color EDX map of the same cross-section shown in FIG. 2 and emphasizes iridium. FIG. 6 shows iridium distributed throughout only the second zone. FIG. 7 is an energy dispersive x-ray spectrum showing the material composition at the first surface 34. FIG. 7 shows that iridium, nickel, chromium and iron are present at the first surface 34.

A gradual transition occurs between the first and second zones with respect to material composition between the non-noble metallic base material and the blend of the non-noble metallic base material and the noble metallic material. The boundary between the first and second zones is irregular. The structure of the spark plug 10 can be achieved according to an exemplary method provided below.

Figure 8:
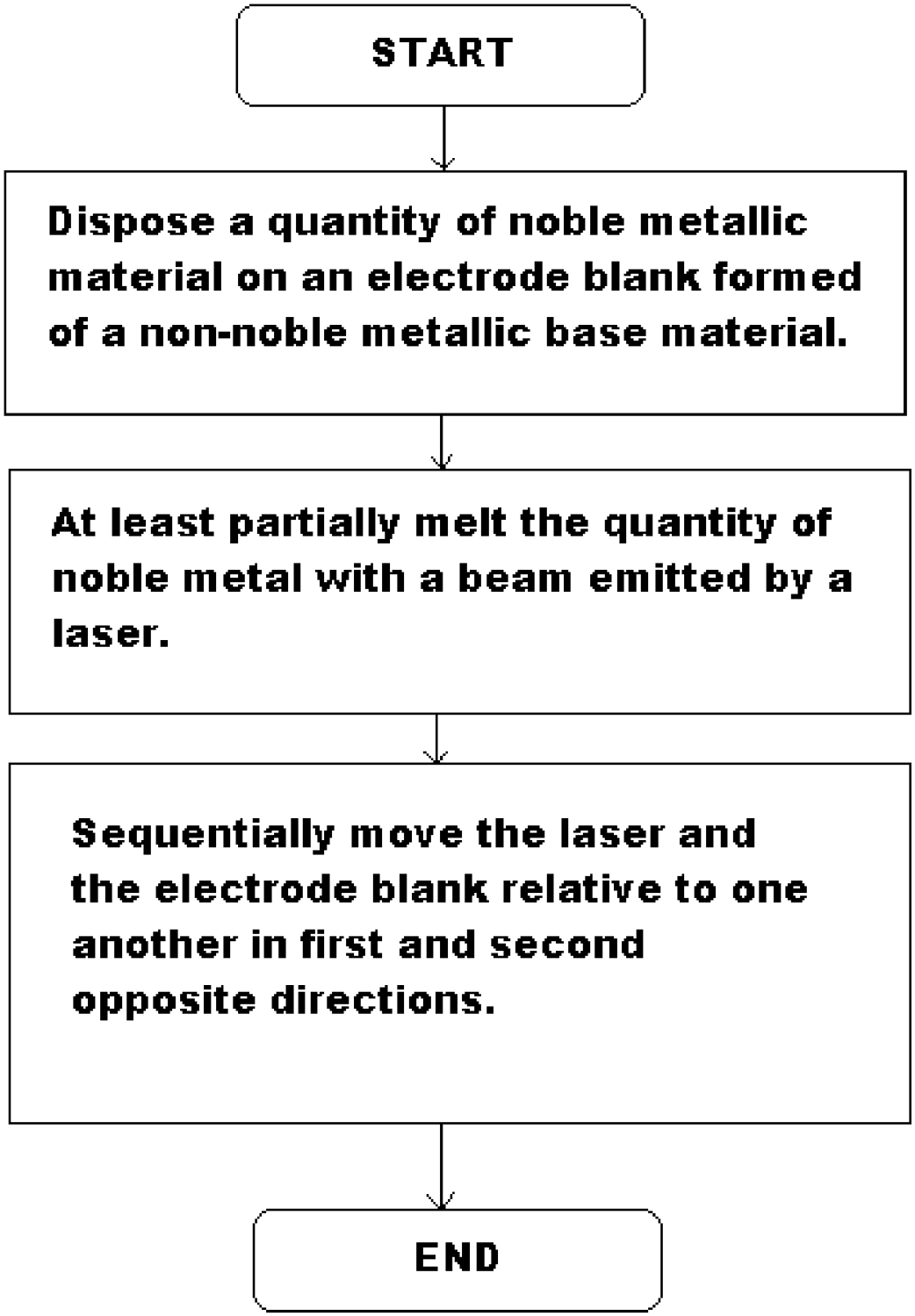
FIG. 8 is a simplified flow diagram of an exemplary process for producing the spark plug.

FIG. 8 is a simplified flow diagram of an exemplary method for forming the ground electrode 18. In a first step, a quantity of noble metallic material is disposed on an electrode blank formed of a non-noble metallic base material. The quantity of noble metallic material can be applied to the electrode blank in the form of a slurry. The slurry can be dried prior to further processing of the ground electrode 18. In a second step, the quantity of noble metal is at least partially melted with a beam emitted by a laser. The laser can be a four kilowatt direct diode laser. The ground electrode 18 can be disposed under a shroud and shielded with argon gas to minimize oxidation.

In a third step, the laser and the electrode blank are sequentially moved relative to one another in first and second opposite directions to enhance the distribution of the molten quantity of noble metal over the electrode blank. For example, the ground electrode 18 or electrode blank can be moved under the laser in a back and forth manner. The output of the laser can be varied during each sequential movement. For example, the beam of the laser can be pulsed during a first sequential movement and continuously emitted during a second sequential movement. Pulsing the beam during the first step reduces heat input and reduces the likelihood of undesirable heat build-up. The pulsing wets the first surface 34 to begin the blending of the non-noble base material and noble metallic material. Slurry containing a quantity of noble metallic material can be applied to the electrode blank prior to each sequential movement during the sequentially moving step. A feedback loop could be added to the illustrate flow chart from the third step back to the first step such that additional slurry is applied prior to each movement to provide the benefit of building an improved first surface. Generally, in each pass, the quantity of noble metallic material and a portion of the non-noble base material pool together. Also, heat at the first surface will gradually build during multiple passes, resulting in a deeper and deeper pool. Gradually increasing the amount of noble metal on the first surface 34, through sequential applications of slurry, allows for the gradual blending of the non-noble base material and the noble metallic material.

Many modifications and variations of the present invention are possible in light of the above teachings. It is, therefore, to be understood that within the scope of the appended claims, the invention may be practiced otherwise than as specifically described.

What is claimed is:

1. A spark plug comprising:

a center electrode;

an insulator surrounding said center electrode;

a metallic shell surrounding said insulator; and a ground electrode engaged with said metallic shell and having a first surface facing said center electrode for defining a spark gap and a second surface opposite said first surface, wherein a cross-section of said ground electrode between said first and second surfaces includes a first zone extending from said second surface toward said first surface and a second zone extending from said first zone to said first surface, wherein said first zone is fabricated of a metallic base material that is free of noble metallic material, and said second zone is fabricated of a blend of said metallic base material and a noble metallic material.

2. The spark plug of claim 1 wherein quantities of both of said metallic base material and said noble metallic material are disposed at said first surface.

3. The spark plug of claim 1 wherein a gradual transition occurs between said first and second zones with respect to material composition between said metallic base material and said blend of said metallic base material and said noble metallic material.

4. The spark plug of claim 1 wherein a boundary between said first and second zones is irregular.

5. The spark plug of claim 1 wherein said metallic base material is further defined as including at least one of nickel, iron and chromium.

6. The spark plug of claim 5 wherein said metallic base material is further defined as an alloy including nickel, iron and chromium.

7. The spark plug of claim 1 wherein said noble metallic material is further defined as iridium.

8. A method of forming a spark plug electrode with a noble metal tip according to claim 1 comprising the steps of:

disposing a quantity of noble metallic material on an electrode blank formed of a non-noble metallic base material;

at least partially melting the quantity of noble metal with a beam emitted by a laser; and sequentially moving the laser and the electrode blank relative to one another in first and second opposite directions to enhance the distribution of the molten quantity of noble metal over the electrode blank.

9. The method of claim 8 further comprising the step of:

varying an output of the laser during each sequential movement of said sequentially moving step.

10. The method of claim 8 wherein said disposing step includes the step of:

applying a slurry containing the quantity of noble metallic material to the electrode blank formed of a non-noble metallic base material.

11. The method of claim 8 wherein said disposing step includes the step of:

applying a slurry containing the quantity of noble metallic material to the electrode blank formed of a non-noble metallic base material prior to each sequential movement of said sequentially moving step.

12. The method of claim 8 wherein said at least partially melting step includes the steps of:

pulsing a beam of the laser during a first sequential movement of said sequentially moving step; and continuously emitting the beam of the laser during a second sequential movement of said sequentially moving step.

13. A method of forming a spark plug electrode with a noble metal tip according to claim 1 comprising the steps of:

applying a first quantity of noble metallic material in a slurry to an electrode blank formed of a non-noble metallic base material;

drying the first quantity of noble metallic material to eliminate a liquid carrier in the slurry;

directing a beam of a laser to melt the first quantity of noble metallic material;

moving the laser and the electrode blank relative to one another in a first direction to move the beam along the first quantity of noble metallic material during said directing step;

pulsing the beam during said step of moving the laser and the electrode blank relative to one another in the first direction;

applying a second quantity of noble metallic material in a slurry to the electrode blank over the first quantity of noble metallic material after said moving step;

drying the second quantity of noble metallic material to eliminate a liquid carrier in the second quantity of slurry;

directing the beam of the laser to melt the second quantity of noble metallic material;

moving the laser and the electrode blank relative to one another in a second direction opposite the first direction to move the beam along the second quantity of noble metallic material during said step of directing the beam of the laser to melt the second quantity of noble metallic material; and continuously applying the beam during said step of moving the laser and the electrode blank relative to one another in the second direction.

* * * * *